United States Patent [19]

Schertz et al.

[11] 4,117,760

[45] Oct. 3, 1978

[54] FEED PAWL ANTIBOUNCE DEVICE

[75] Inventors: Charles J. Schertz, Bel Air, Md.; Dennis L. Wilson, Davenport, Iowa

[73] Assignee: The United States of America as represented by the Secretary of the Army, Washington, D.C.

[21] Appl. No.: 787,407

[22] Filed: Apr. 14, 1977

[51] Int. Cl.[2] ..... F41D 9/02

[52] U.S. Cl. ..... 89/33 C

[58] Field of Search ..... 89/33 R, 33 B, 33 BB, 89/33 BL, 33 C, 33 CA

[56] References Cited

U.S. PATENT DOCUMENTS 2,974,569 4/1961 Cross ..... 89/33 C

*Primary Examiner*—Stephen C. Bentley

*Attorney, Agent, or Firm*—Nathan Edelberg; Robert O. Richardson

[57] ABSTRACT

A feed pawl antibounce device that prevents jamming of a round feed apparatus when the pawl clears the round and is moved into position to feed the round from its feed position to its chambering position in front of the open bolt.

6 Claims, 13 Drawing Figures

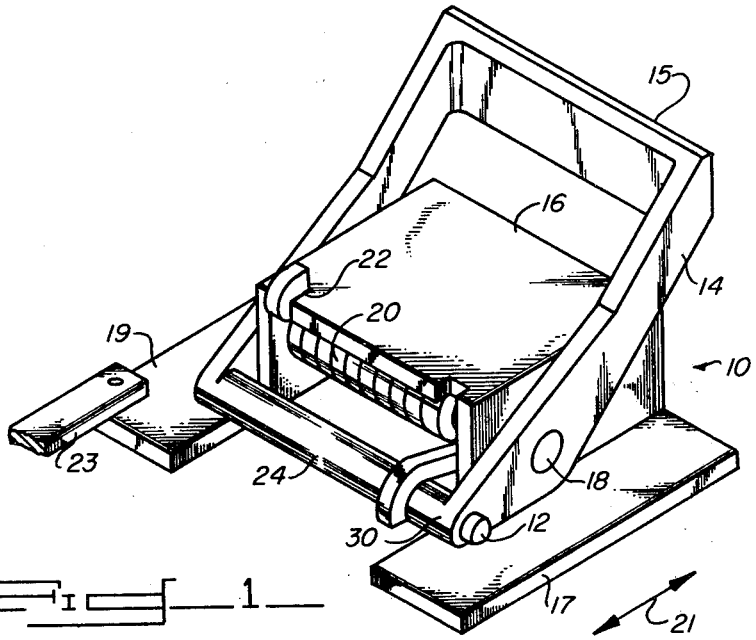
FIG. 1
FIG. 2
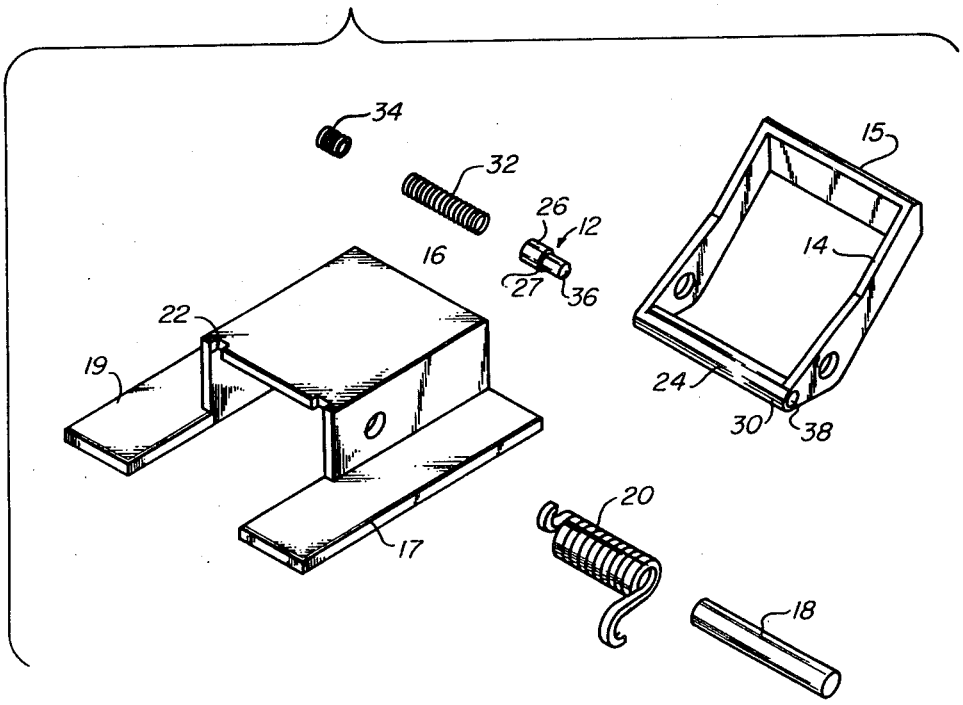

FEED PAWL ANTIBOUNCE DEVICE

GOVERNMENT RIGHTS

The invention described herein may be manufactured and/or used by or for the Government for governmental purposes without the payment of any royalty thereon.

BACKGROUND OF THE INVENTION

In automatic weapons, that is, a weapon capable of firing more than one round before manual reloading is necessary, a common method of transferring a round from the feed tray to the feed position is by the use of a feed pawl. This is simply a pivotally mounted lever which pushes the round into the weapon receiver where it is chambered and made ready for firing. The pawl is carried by a base which rides in slots in the feed tray. The base reciprocates in the feed tray by means of a linkage between recoiling parts of the weapon system and the base. The reciprocating motion of the base and pawl is utilized to push cartridges from the feed tray to a position where chambering may be accomplished. On the return stroke the pawl must deflect downward under the next round to be fed. When the pawl, carried by the base, has traveled a sufficient amount to clear the next round, it is returned under spring tension to its original upright position.

An undesirable characteristic of this system is the tendency of the feed pawl to bounce downward again after it snaps free from the incoming round. This can cause a failure to feed to occur because tha pawl is trapped under the round instead of pushing against it. Consequently, the round is not advanced to the feed position and a stoppage occurs.

SUMMARY OF THE INVENTION

In the present invention the feed pawl is pivotally mounted to a carrier which reciprocates within the feed tray. The feed pawl is urged upward toward the ready-to-feed position by a torsion spring which surrounds the pivot pin. In accordance with the present invention, the pawl houses at its lower end a spring loaded plunger to eliminate the undesirable pawl bounce that occurs in previous devices. This is accomplished by engagement of the plunger with a cam slot in the feed tray. This cam slot restricts pivotal movement of the pawl as it snaps free of the incoming round in the feed tray and is then ready for the feed movement. The pawl is then retained in this ready-to-feed position until it engages the round in the feed tray. At this point the plunger is being depressed back into the pawl by the cam slot which reduces in depth as the round approaches the feed position. As the round reaches the feed position the cam slot becomes nonexistent. The plunger is then completely depressed inside the feed pawl which is again freed for pivotal movement. The pawl may then deflect under the next incoming round in the feed tray as the next cycle is initiated.

BRIEF DESCRIPTION OF DRAWINGS

FIG. 1 is a view in perspective of the feed pawl assembly,

FIG. 2 is an exploded view in perspective of the components of the feed pawl assembly.

DETAILED DESCRIPTION OF A PREFERRED EMBODIMENT

Figure 3:
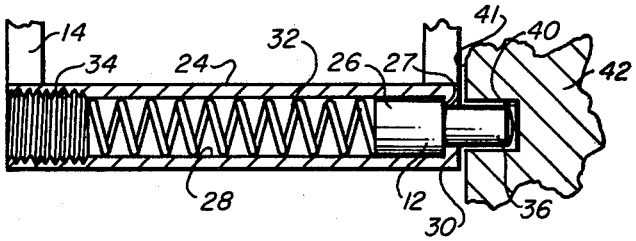
FIG. 3 is a sectional view of the tubular section of the feed pawl showing the spring loaded plunger in engagement with the feed tray cam slot, and FIGS. 4*a* & *b* through 8*a* & *b* are respectively rear and top views of an automatic weapon showing the sequence of operation of the feed pawl and the plunger.

Reference is made to FIG. 1 wherein there is shown a feed pawl assembly 10 in accordance with the present invention. The feed pawl 14 is a rectangular shaped pivotal lever having a tubular section 24 at its lower end and a round contacting surface 15 at its upper end. The tubular section 24 houses a depressible plunger 12 which engages a cam slot in the feed tray, shown in FIG. 3, to provide the antibounce improvement of the present invention. The feed pawl 14 is pivotally mounted to a carrier 16 by means of a pivot pin 18. The pivot pin 18 also serves as a support or guide for a torsion spring 20. The spring 20 engages a notch 22 in the carrier 16 and the tubular section 24 of the feed pawl 14 to urge the pawl to its uppermost or ready-to-feed position, as shown. The carrier 16 has two elongated flattened portions 17 and 19. These serve as bearings and slide in the directions of double-pointed arrow 21, which is transverse to the axis of the weapon. These bearings 17, 19 slide in slots in the feed tray shown in FIG. 4. Push means 23 coordinates this movement with bolt and sprocket action.

As can be seen in FIGS. 2 and 3, the rear section 26 of the plunger 12 is of a larger diameter than the tip 36. This provides a shoulder 27 which engages the inner wall of the tubular section 24 to retain the plunger 12 in the bore 28. The plunger 12 is urged toward end 30 of the tubular section 24 by a compression spring 32. The spring 32 is retained in bore 28 by a set screw 34. As shown in FIG. 3, the tip 36 of the plunger 12 extends through an aperture 38 in end 30 of the tubular section 24. The tip 36 may then engage a longitudinally extending cam slot 40. This slot is adjacent the feed pawl in a vertical wall 41 of the feed tray 42. This prevents pivotal movement of the feed pawl 14 as the feed pawl assembly 10 moves a round from feed position into the weapon receiver, and thus assures reliable feeding.

Figure 4A:
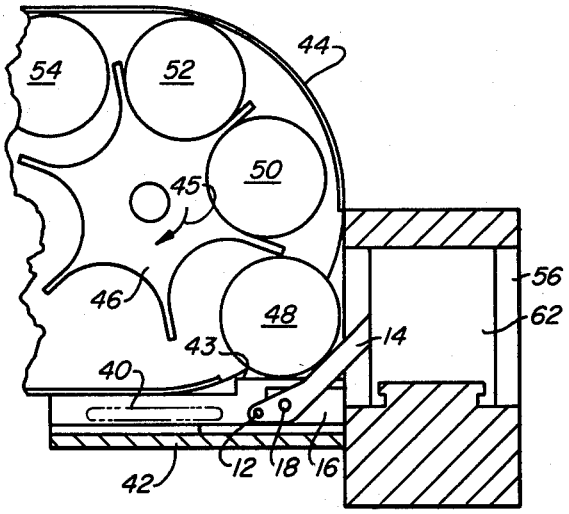

A weapon system incorporating a feed pawl with depressible plunger in accordance with the present invention is shown in FIGS. 4*a* & *b* through 8*a* & *b*. As shown in FIG. 4*a*, a magazine 44 having a sprocket 46 is utilized to advance rounds 48–54 to the feed tray 42 where they are supported by ledge 43 during the feeding process. The sprocket rotates in the direction of arrow 45 and is indexed in proper sequence to advance the rounds during the feed cycle. Round 48 is positioned in the feed tray 42 ready to be transferred to the receiver 56 during the next feed cycle. Note that the cam slot 40 has been cut away in sectioning FIGS. 4*a* through 8*a*; however, for clarity, the position of the slot is shown in phantom lines in these views.

Figure 4B:
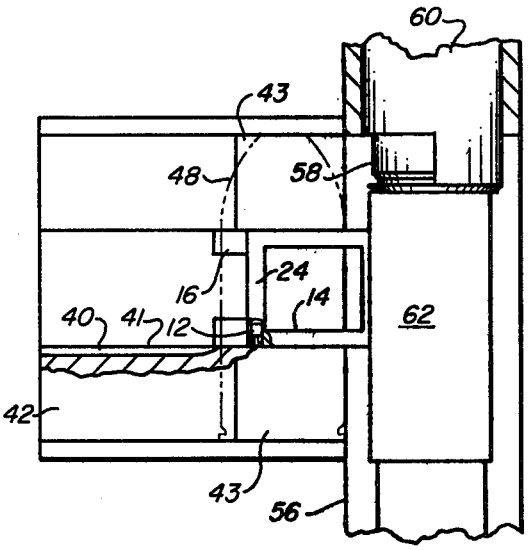

FIG. 4*b* shows a spent cartridge case 58 in the weapon chamber 60 ready for extraction and ejection by the bolt 62 before the next round 48 is introduced. As can also be seen, the plunger 12 is completely depressed within the tubular section 24 of the feed pawl 14. This allows free pivotal movement of the pawl 14 about its axis 18. It should be noted that in FIGS. 4*b* through 8*b* the magazine 44 is omitted for clarity.

Figure 5A:
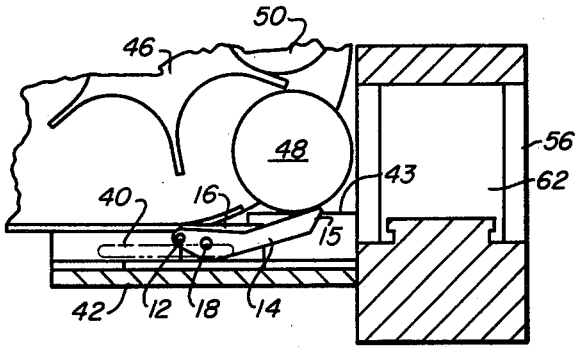
Figure 5B:
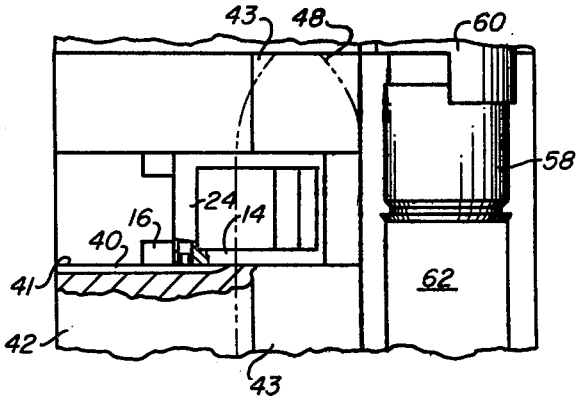

The feed cycle is initiated as the carrier 16 moves to the left, as shown in FIGS. 5*a* & *b*. The feed pawl 14 must pivot under round 48 as the carrier 16 progresses to the left. Note that the plunger remains depressed within the tubular section 24. This is because the plunger 12 is not aligned with the cam slot 40 when the pawl 14 is pivoted under round 48. However, the plunger 12 does align with slot 40 when the pawl 14 is in the uppermost or ready-to-feed position as shown in FIG. 6.

Figure 6A:
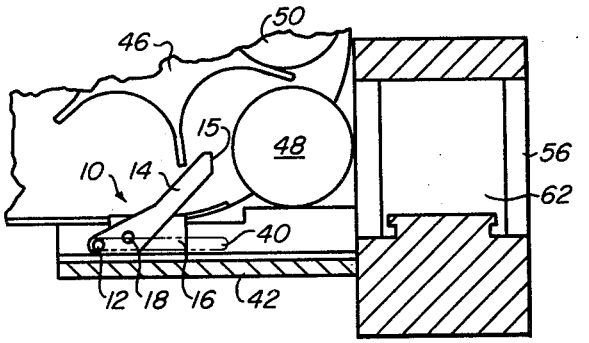
Figure 6B:
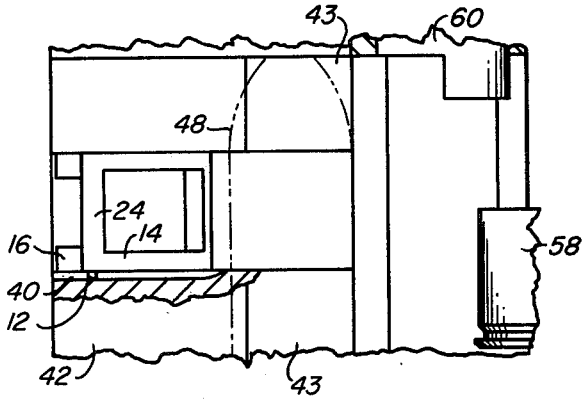

In FIGS. 6*a* & *b* the feed pawl assembly 10 has reached a point in its movement toward the left where the pawl 14 is allowed to swing free of the incoming round 48. The torsion spring 20 (FIG. 2) then urges the pawl 14 to its uppermost or ready-to-feed position as shown. As the pawl reaches its upper limit, the plunger 12 is aligned with the cam slot 40. When this occurs, the plunger 12 is urged into engagement with the cam slot 40 by spring 32 (FIG. 2) to lock the pawl in its ready-to-feed position. Note that extraction of spent case 58 has already occurred and its ejection is in progress, anticipating feeding of round 48 into chamber 60.

Figure 7A:
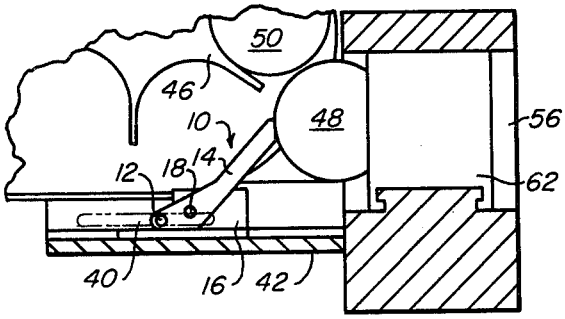
Figure 7B:
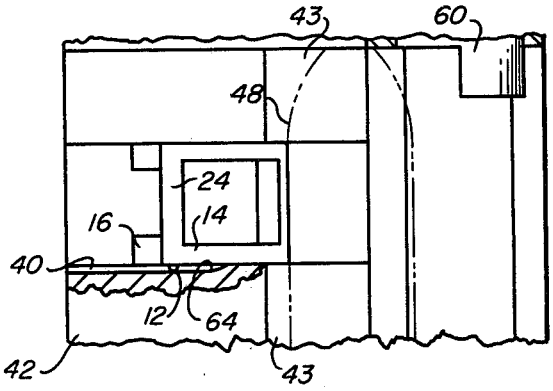

FIGS. 7*a* & *b* show the next step in the feed cycle. As shown, the pawl 14 remains locked in non-pivoting condition as the pawl assembly 10 moves to the right and engages round 48. The pawl pushes the round 48 from the feed tray 42 into the receiver 56. At this point the sprocket 46 is indexed to move the next round 50 to a position previously occupied by round 48 to be moved by pawl 14 during the next feed cycle.

Figure 8A:
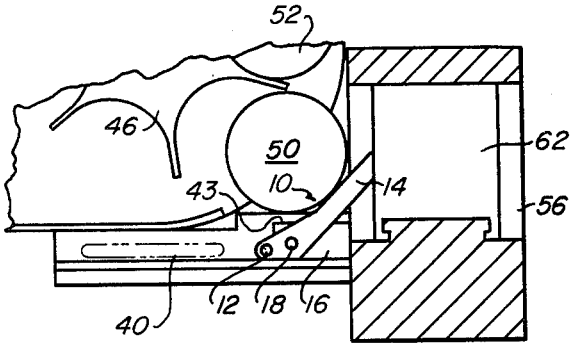
Figure 8B:
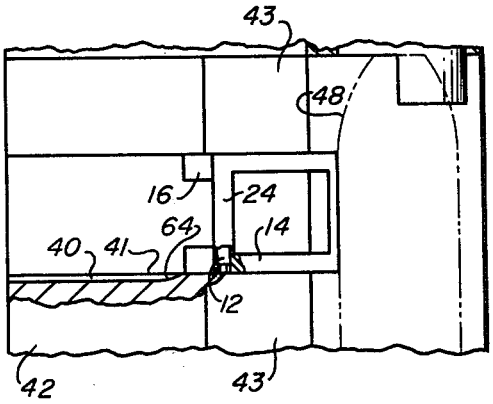

During the final period of travel of the feed pawl assembly 10, as shown in FIGS. 8*a* & *b*, the plunger 12 contacts a ramp section 64 which is a reduction in depth of the cam slot 40. As shown the ramp section 64 terminates flush with the wall 41 of the feed tray 42. As the feed pawl assembly 10 progresses further to the right, the plunger 12 rides along the ramp section 64 which depresses it inside the tubular section 24 as shown in FIG. 8*b*. The round 48 is now positioned for chambering by the bolt 62. The pawl 14 is freed for pivotal movement and is ready for initiation of the next feed cycle, such as shown in FIG. 4.

The invention in its broader aspects is not limited to the specific combinations, improvements and instrumentalities described but departures may be made therefrom within the scope of the accompanying claims without departing from the principles of the invention and without sacrificing its chief advantages.

What we claim is:

1. A feed pawl antibounce device for use in feeding rounds into an automatic weapon, said device comprising a feed pawl assembly and a feed tray, said feed tray having a ledge upon which rounds are deposited for feeding into the receiver of said weapon, said feed pawl assembly having a carrier movably mounted on said weapon, a feed pawl pivotally mounted on said carrier for movement between a depressed position as said pawl passes under a round on said ledge, and a spring urged raised ready-to-feed position wherein said pawl moves said round from said ledge into said receiver, and means retaining said pawl in said raised position as said pawl moves said round into said receiver, said retaining means including a wall in said tray with a slot therein, said slot having a ramp portion terminating flush with said wall, and depressible means on said pawl engageable with said slot, said depressible means being depressed by said ramp to free said pawl for pivotal movement as said carrier moves on said weapon.

2. A feed pawl antibounce device as in claim 1 wherein said carrier moves laterally from said feed tray to said receiver as said depressible means moves along said slot and is depressed by said ramp.

3. A feed pawl antibounce device as in claim 2 wherein said depressible means is disengaged from said slot and said pawl is pivoted to said depressed position as said carrier moves from said receiver to said feed tray position.

4. A feed pawl antibounce device as in claim 3 wherein said pawl pivots to its raised ready-to-feed position and said depressible means engages said slot as said carrier moves to said feed tray position.

5. A feed pawl antibounce device as in claim 1 wherein said depressible means is a spring biased plunger.

6. A feed pawl antibounce device as in claim 5 wherein said pawl includes a horizontally extending tubular section having an aperture in one end thereof, a plunger within said tubular section having a tip protruding through said aperture, and a spring in said tubular section urging said plunger against said one end.

* * * * *